US006463984B2

(12) United States Patent
Glover

(10) Patent No.: US 6,463,984 B2
(45) Date of Patent: Oct. 15, 2002

(54) CURTAIN ROD ASSEMBLY WITH HOOK AND LOOP FASTENER INSERTS

(76) Inventor: Elizabeth Alice Glover, 401 Family Cir., Hutto, TX (US) 78634

( * ) Notice: Subject to any disclaimer, the term of this patent is extended or adjusted under 35 U.S.C. 154(b) by 0 days.

(21) Appl. No.: 09/793,237

(22) Filed: Feb. 26, 2001

(65) Prior Publication Data

US 2001/0008176 A1 Jul. 19, 2001

Related U.S. Application Data

(63) Continuation-in-part of application No. 09/116,749, filed on Jul. 16, 1998, now Pat. No. 6,192,962.

(51) Int. Cl.[7] ..... A47H 1/00

(52) U.S. Cl. ..... 160/39; 160/126; 160/330; 160/368.1; 248/265

(58) Field of Search ..... 160/19, 38, 39, 160/123, 126, 368.1, 330; 211/105.1, 105.3; 248/262, 265; 16/87.4 R, 93 R, 93 D, 95 R

(56) References Cited

U.S. PATENT DOCUMENTS

| | | | |
|---|---|---|---|
| 572,249 | A | 12/1896 | Eckert |
| 1,199,673 | A | 9/1916 | Donovan |
| 1,764,611 | A | 7/1930 | De Lisle |
| 1,813,556 | A | 7/1931 | Young |
| 4,782,883 | A | 11/1988 | Braiotta |
| 5,074,348 | A | 12/1991 | Phillips |
| 5,146,972 | A | 9/1992 | Tacchella |
| 5,205,337 | A | 4/1993 | Bozzo |
| 5,295,595 | A | 3/1994 | Gobidas et al. |
| 5,335,709 | A | 8/1994 | Borzi |
| 5,544,692 | A | 8/1996 | McMichael |
| 5,673,741 | A | 10/1997 | Cairns |
| 6,192,962 | B1 * | 2/2001 | Glover |

FOREIGN PATENT DOCUMENTS

| | | |
|---|---|---|
| FR | 2397-177 | 3/1979 |
| GB | 1078248 | 8/1967 |
| GB | 2 252 033 A | 7/1992 |

* cited by examiner

*Primary Examiner*—Blair M. Johnson
(74) *Attorney, Agent, or Firm*—Coats & Bennett, P.L.L.C.

(57) ABSTRACT

A curtain rod assembly includes a curtain rod and a plurality of inserts coupled to the curtain rod. Distributed about the polygonal cross-section of the curtain rod are surfaces disposed substantially parallel to the longitudinal axis and non-coplanar with respect to each other. The inserts are coupled to these surfaces such that the inserts' respective external faces, having a first portion of a hook and loop fastener thereon, are disposed for attachment thereto from different directions. Preferably, the inserts may slide along the curtain rod to be positionable at any desired position. One or more window treatment panels may be attached to the curtain rod via the inserts using hook and loop fastener of a complementary type to the hook and loop fastener on the inserts.

30 Claims, 6 Drawing Sheets

CURTAIN ROD ASSEMBLY WITH HOOK AND LOOP FASTENER INSERTS

RELATED APPLICATIONS

This is a continuation-in-part of application Ser. No. 09/116,749, filed Jul. 16, 1998, now U.S. Pat. No. 6,192,962, which is incorporated herein by reference.

BACKGROUND OF THE INVENTION

The present invention relates to the display and support of window treatment panels (e.g., curtains, draperies), such as about one or more windows.

Typically, window treatments panels are hung by means of pockets, staples, or tacks, from a horizontal rod or cornice board attached to the wall over a window. The conventional method typically requires the entire window treatment to be attached to the rod before attaching the rod to the wall, or entails complicated attachment procedures requiring substantial dexterity. In addition, the size and weight of the panels often requires two people to hang the panels in a conventional manner; and multiple rods are typically required if a layered effect is desired. As a result, and due to the relatively high cost of conventional equipment, window treatments are not routinely modified once installed.

BRIEF SUMMARY OF THE INVENTION

A curtain rod assembly of the present invention is easy to assemble and easily accommodates changes to the desired window treatment effect. The curtain rod assembly includes a curtain rod and a plurality of inserts coupled to the curtain rod. The curtain rod has a longitudinal axis and a generally polygonal cross section. Distributed about the polygonal cross-section are at least first, second, and third surfaces disposed substantially parallel to the longitudinal axis and non-coplanar with respect to each other. First, second, and third inserts are coupled to the first, second, and third surfaces, respectively. Each insert has an external face with a first portion of a hook and loop fastener thereon. The first insert is coupled to the curtain rod such that its respective external face is disposed for attachment thereto from a first direction; the second insert is coupled to the curtain rod such that its respective external face is disposed for attachment thereto from a second direction; the third insert is coupled to the curtain rod such that its respective external face is disposed for attachment thereto from a third direction; with each of the directions being different from the others. Optionally, the inserts may be releasably coupled to the curtain rod, such as by snaps, screws, or the like, or via a sliding fit so as to be positionable at any desired position. The inserts may run substantially the entire length of the curtain rod or may be shorter sections that can be located at the appropriate location(s) along the curtain rod. A mounting bracket may be used to connect the curtain rod to the corresponding wall so as to support the curtain rod assembly therefrom.

One or more window treatment panels may be attached to the curtain rod via the inserts using hook and loop fasteners of a complementary type to the hook and loop fastener on the inserts. Having inserts that run substantially the entire length of the curtain rod, or alternatively allowing the inserts to be located at various positions along the curtain rod, provides significant flexibility in window treatment design. For instance, a "wide" window treatment panel may be supported along one side of the curtain rod, and this "wide" panel may be removed and replaced with a "narrow" panel without substantial effort. In addition, the inclusion of the hook and loop fastener on at least three, and preferably all, sides of the curtain rod allows the curtain rod to be installed in a plurality of orientations and still function properly, and additionally to hold window treatment panels in a three (or more) layer overlapping configuration, if desired.

DETAILED DESCRIPTION OF THE INVENTION

Referring to the Figures, a curtain rod assembly of the present invention, generally indicated at 15, includes a generally rigid curtain rod 20 and a plurality of inserts 300 coupled to the curtain rod 20.

Figure 1:
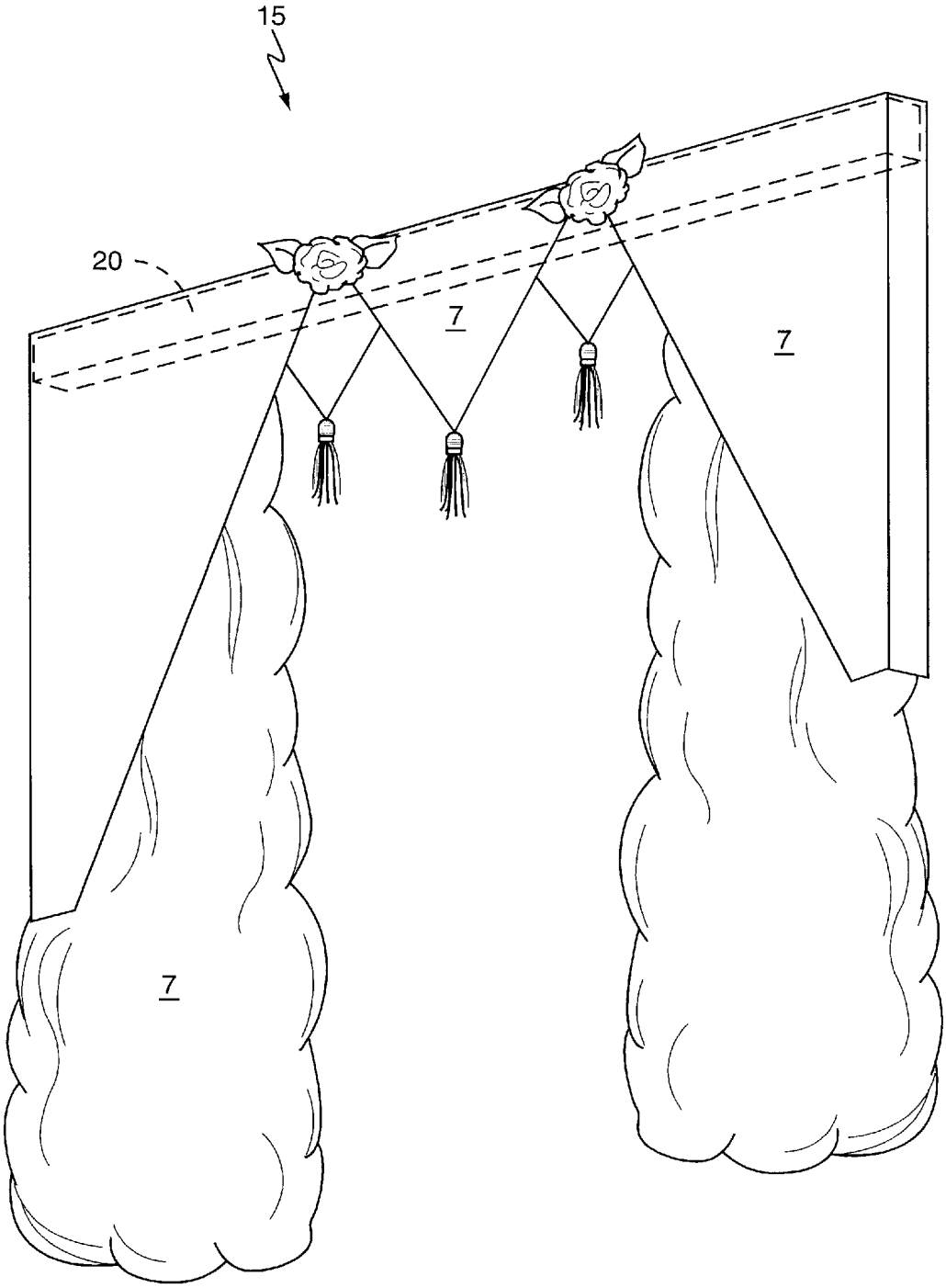
FIG. 1 shows one embodiment of the curtain rod assembly of the present invention with window treatment panels attached.
Figure 2:
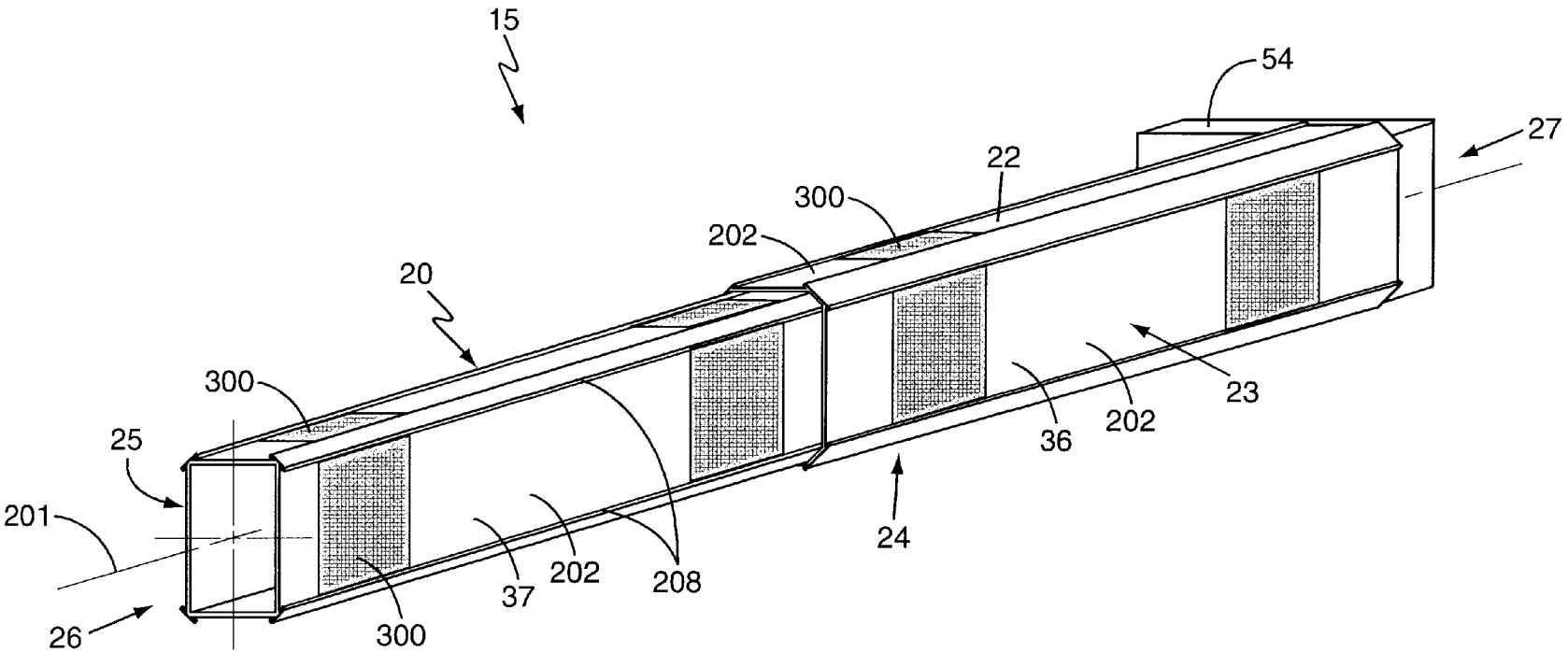
FIG. 2 shows the curtain rod assembly of FIG. 1 without window treatment panels.

The curtain rod 20 holds the inserts 300, which are use to fasten one or more window treatment panels 7 to the curtain rod 20, as discussed further below. The curtain rod 20 has a generally polygonal cross-section, such as the rectangular cross-section shown in FIG. 3, and extends along a longitudinal axis 201. For simplicity, the curtain rod 20 and the corresponding longitudinal axis 201 are shown as straight, but this is not required and the curtain rod 20 may take the form of an arch, an S-shape, etc. The sides 22,23,24,25 of the curtain rod 20 form support surfaces that are mutually non-coplanar. Running along the support surfaces, generally parallel to the longitudinal axis 201, are optional channels 202 with corresponding channel lips 208. The channels 202 may preferably run the entire length of the curtain rod 20 to aid in assembly and manufacture, but the channels 202 may also extend along only a portion thereof. As shown in FIG. 2, the curtain rod 20 may be advantageously designed to telescope so as to provide easy length adjustment, with the male portion 37 of the curtain rod 20 telescoping into the female portion 36 of the curtain rod 20.

Figure 3:
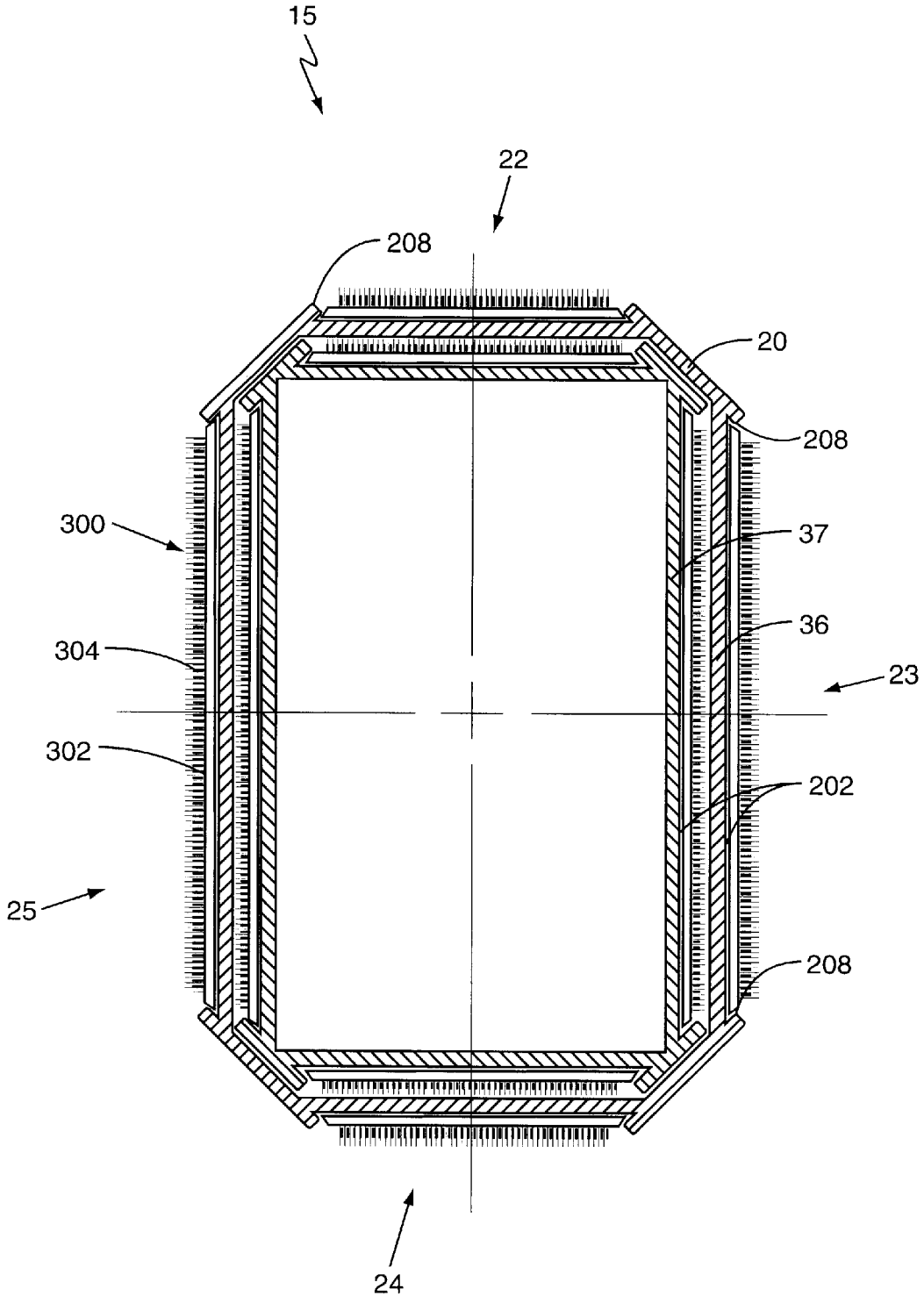
FIG. 3 shows a cross-sectional view of the curtain rod assembly of FIG. 2.

A plurality of inserts 300 are coupled to the curtain rod 20. For instance, the inserts 300 may be slidably mounted in the channels 202 on the respective sides 22,23,24,25 of the curtain rod 20, as shown in FIG. 3. The inserts 300 have at least one generally planar face 302 substantially covered with one portion of a hook and loop fastener 304 (e.g., VELCRO or similar material). There may be one insert 300 per side 22,23,24,25 of the curtain rod 20, or each side 22,23,24,25 of the curtain rod 20 may have two or more corresponding inserts 300. The inserts 300 shown in FIG. 2 are thin, generally rectangular (see FIG. 4), and extend at most only slightly out from the corresponding side 22,23, 24,25 of the curtain rod 20. These inserts 300 may be easily formed by cutting suitable lengths of VELSTICK available from Velcro Industries B.V. of Amsterdam, Netherlands. The length of the inserts 300 may be substantially as long as the curtain rod 20, such that a single insert 300 extends over substantially the entire length of the corresponding side 22,23,24,25 of the curtain rod 20. Alternatively, the inserts 300 may be substantially shorter in length, such as when multiple inserts 300 are to be used for a given side 22,23, 24,25 of the curtain rod 20 (as shown in FIG. 2). Insert widths in the general range of one inch to 1¾ inch have been shown to be suitable in practice. The inserts 300 may be joined to the curtain rod 20 by screws, snaps, or the like, so as to be repeatedly removable therefrom. In a preferred embodiment, the inserts 300 are coupled to the curtain rod 20 via a sliding fit therewith wherein the inserts are retained in the channels 202 by the corresponding channel lips 208. For an illustrative example of such a coupling arrangement, see FIG. 3. The use of the sliding fit coupling between the inserts 300 and the curtain rod 20 allows for greater flexibility in locating inserts 300 along the longitudinal axis 201 than may be available in some other embodiments that may limit the available locations to a group of predetermined discrete positions along the curtain rod 20.

Figure 4:
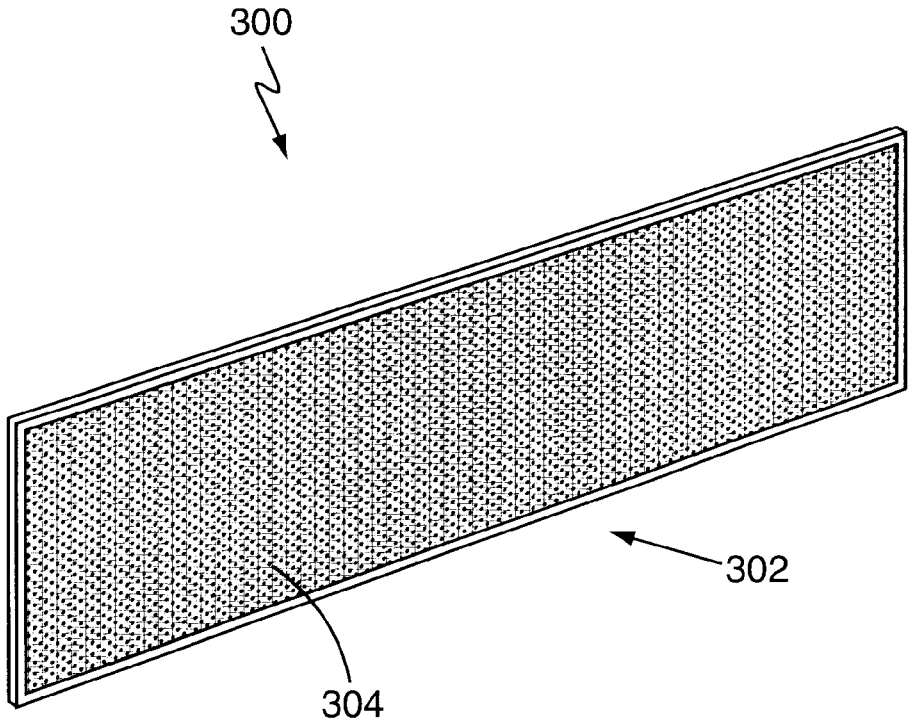
FIG. 4 shows a perspective view of one embodiment of the inserts shown in FIG. 2 and FIG. 3.
Figure 5:
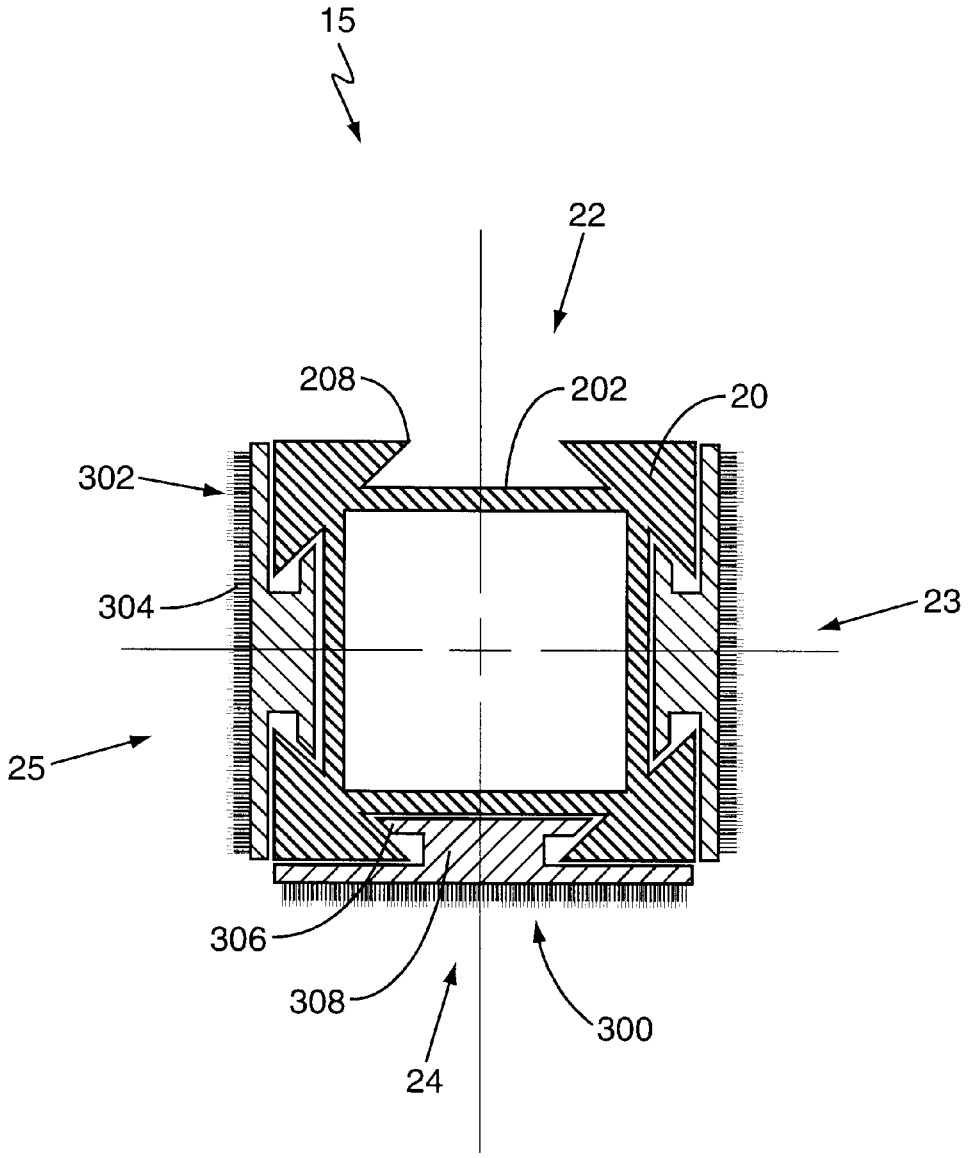
FIG. 5 shows an alternative embodiment of the curtain rod assembly of the present invention.

FIG. 5 shows an alternative embodiment of the curtain rod assembly 15 that differs from the embodiment of FIGS. 2–4 mainly in the physical configuration of the inserts 300. In the FIG. 5 embodiment, the generally planar external face 302 of the inserts 300 are spaced away from the curtain rod 20. As shown in FIG. 5, the inserts 300 have a pair of legs 306 that engage the respective channel lips 208 on the curtain rod 20 and an intermediate rib 308 that extends from the legs 306 to the back side of the planar portion 302. Of course, the particular configuration of the legs 306 is unimportant and the "legs" may even be replaced by a section having a trapezoid shaped cross-section, or the like. It should be noted that inserts 300 with longer ribs 308 may be used in conjunction with the male portion 37 of the curtain rod 20, so that the external faces 302 of inserts 300 on both the male portion 37 and the female portion 36 of the curtain rod 20 may advantageously be aligned along a single plane.

The curtain rod 20 may be secured in place proximate the corresponding window (or windows) by an optional mounting bracket 54 which preferably is affixed to the surrounding wall by suitable fasteners (e.g., screws) known in the art. There may be one bracket 54 for each end of the curtain rod 20, but configurations using a single centrally located bracket 54, and/or intermediate brackets 54, are also possible. Indeed no mounting bracket is required if the curtain rod 20 is mounted directly to the wall, but preferred embodiments employ one or more brackets 54. The particular details of the bracket 54 are unimportant to the present invention, and any known bracket 54 may be used, such as the mounting blocks of application Ser. No. 09/116,749. However, it may be advantageous to allow the curtain rod 20 to easily snap into and out of the brackets 54 to facilitate assembly and maintenance. In addition, it may be advantageous to have additional hook and loop fastener disposed on the outer portion of the brackets 54 to supply additional securing locations for window treatment panels 7.

Suitable window treatments, such as curtains, drapes, swags, flags, valances, tapestries, banners, quilts, and the like (generically referred to as window treatment panels 7) may be attached to the curtain rod 20 via the inserts 300. The window treatment panels 7 have complementary portions of a hook and loop fastener 304 sewn or otherwise secured thereto (see FIG. 7). Typically, each panel 7 has a strip, patch, or series of strips or patches, of a portion of hook and loop fastener 304 secured to the front or back of the panel 7. The two complementary portions of the hook and loop fastener 304—on the insert 300 and on the window treatment panel 7—are pressed together to join the window treatment panel 7 to the curtain rod 20. Preferably, the curtain rod 20 is already secured to the wall proximate the corresponding window(s) by the mounting bracket(s) 54, but this is not strictly required for all embodiments. Likewise, the inserts 300 should be already mated to the curtain rod 20 prior to the addition of the window treatment panel(s) 7, but this is also not strictly required for all embodiments.

Providing hook and loop fastener at various positions along the curtain rod 20, such as by having the inserts 300 be as long as the curtain rod 20 or by allowing the inserts 300 to slide along the curtain rod 20 to various locations, provides significant flexibility in window treatment design. For instance, an "old" window treatment panel 7 may be supported by a long insert 300 along one side 22,23,24,25 of the curtain rod 20. This "old" panel 7 may be removed and replaced with a "new" panel 7 by simply breaking the joint formed by the complementary portions of the hook and loop fasteners on the insert 300 and the "old" panel 7, putting the "old" panel 7 aside, and mating the "new" panel 7 to the curtain rod 20 by forming a new joint between the complementary portions of the hook and loop fasteners on the insert 300 and the "new" panel 7. As can be seen, this process is not unduly complex and does not require significant dexterity. Likewise, if multiple shorter-length inserts 300 are used instead, an "old-wide" window treatment panel 7 may be supported by two inserts 300 along one side 22,23,24,25 of the curtain rod 20. This "old-wide" panel 7 may be removed and replaced with a "new-narrow" panel 7 by simply breaking the joint formed by the complementary portions of the hook and loop fasteners on the inserts 300 and the "old-wide" panel 7, putting the "old" panel 7 aside, relocating the appropriate insert(s) 300 along the curtain rod 20, and mating the "new-narrow" panel 7 to the curtain rod 20 by forming a new joint between the complementary portions of the hook and loop fasteners on the insert 300 and the "new-narrow" panel 7.

Figure 6:
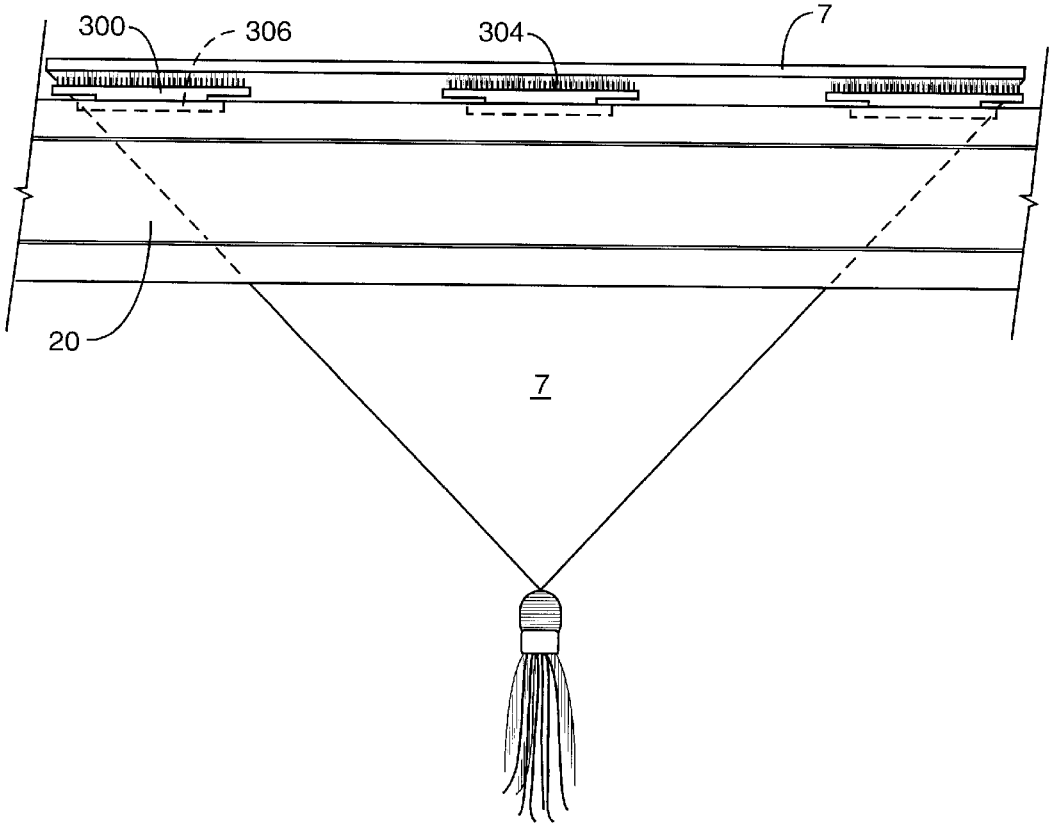
FIG. 6 shows a rear view of the curtain rod assembly of FIG. 5 with a top-mounted window treatment panel attached.

It should be noted that if multiple shorter-length inserts 300 are used for the "top" side 22 of the curtain rod 20 in particular, one or more intermediate inserts 300 should be used to prop up the middle of the window treatment panel 7 if the inserts 300 are short in length. See FIG. 6.

The inclusion of the hook and loop fastener 304 on at least three, and preferably all, sides 22,23,24,25 of the curtain rod 20 allows the curtain rod 20 to be installed in a plurality of orientations and still function properly. For instance, the curtain rod 20 may be installed "front" first or "back" first without a reduction in functionality. Also, the three or more sides 22,23,24,25 allows the curtain rod 20 to hold window treatment panels 7 in a three (or more) layer overlapping condition. For instance, the "back" 25 may support a panel 7 in a center position, with the "front" 23 supporting two further panels 7 disposed slightly away from the center, but visually overlapping the first panel 7 when viewed from the front, and the top 22 supporting another short (hanging length) piece overlaying the other three panels 7. Thus, the present invention allows multiple panels 7 to overlap to form three or more layers, with the various layers supported from different surfaces 22,23,24,25 of the curtain rod 20.

It should be noted that the curtain rod 20 may be made from aluminum or other metal, wood, plastic, other synthetic material, or any other type of suitably strong but lightweight material. A telescoping curtain rod 20 made from aluminum, with a female portion 36 having approximate dimensions of 1.5 inch wide, 2.3 inch high, and telescoping out to about ten feet long has been found acceptable in practice. The inserts 300 may be made from plastic, such as nylon or polyester, or any other suitable material known in the art. Appropriate colors for the curtain rod 20 and inserts 300 include black, white, and beige, but other colors may also be employed.

As pointed out above, the term "window treatment panels," as used herein is intended to encompass curtains, drapes, swags, flags, valances, tapestries, banners, quilts, and the like. Thus, while the discussion above has been in terms of supporting window treatment panels 7 proximate a window, it should be noted that the apparatus 15 may also be used to support wall hangings at locations along a wall not proximate a window, for decorative or other purposes.

The present invention may, of course, be carried out in other specific ways than those herein set forth without departing from the scope of the invention. The present embodiments are, therefore, to be considered in all respects as illustrative and not restrictive, and all changes coming within the meaning and equivalency range of the appended claims are intended to be embraced therein.

What is claimed is:

1. A curtain rod assembly, comprising:

a curtain rod having a longitudinal axis and a generally polygonal cross section generally normal to said longitudinal axis, said curtain rod having at least first, second, and third surfaces disposed substantially parallel to said longitudinal axis and non-coplanar with respect to each other;

first, second, and third inserts each having an external face with a first portion of a hook and loop fastener thereon;

said first insert coupled to said curtain rod such that its respective external face is disposed generally parallel to said first surface of said curtain rod for attachment thereto from a first direction;

said second insert coupled to said curtain rod such that its respective external face is disposed generally parallel to said second surface of said curtain rod for attachment thereto from a second direction; said second direction different from said first direction;

said third insert coupled to said curtain rod such that its respective external face is disposed generally parallel to said third surface of said curtain rod for attachment thereto from a third direction; said third direction different from both said first and second directions; and wherein said first, second, and third inserts are movably mounted to said curtain rod.

2. The assembly of claim 1 wherein said first, second, and third inserts are releasably coupled to said first, second, and third sides of said curtain rod, respectively.

3. The assembly of claim 2 wherein said first insert slidably mounts along said first surface.

4. The assembly of claim 3 wherein said second and third insert slidably mount along said second and third surfaces of said curtain rod, respectively.

5. The assembly of claim 1 wherein said external faces of said first, second, and third inserts are substantially covered by said first portion of a hook and loop fastener.

6. The assembly of claim 1 wherein said first, second, and third inserts are substantially identical.

7. The assembly of claim 1 wherein said curtain rod includes a first channel along said first surface and wherein said first insert mates with said first channel.

8. The assembly of claim 7 wherein said curtain rod further includes a second channel along said second surface and wherein said second insert mates with said second channel.

9. The assembly of claim 8 wherein said curtain rod further includes a third channel along said third surface and wherein said third insert mates with said third channel.

10. The assembly of claim 1 wherein said curtain rod has a generally rectangular cross section.

11. The assembly of claim 1 wherein said curtain rod is telescoping.

12. The assembly of claim 1 further comprising at least one mounting bracket connected to said curtain rod and adapted to secure said curtain rod to a wall.

13. The assembly of claim 1 further comprising:

a first window treatment panel attached to said first insert from a first direction;

a second window treatment panel attached to said second insert from a second direction; and a third window treatment panel attached to said third insert from a third direction.

14. The assembly of claim 1 further comprising a fourth insert having an external face substantially covered by a first portion of a hook and loop fastener, said fourth insert releasably coupled to said first surface of said curtain rod such that its respective external face is disposed for attachment thereto from said first direction.

15. The assembly of claim 14 further comprising a fifth insert having an external face substantially covered by a first portion of a hook and loop fastener, said fifth insert releasably coupled to said second surface of said curtain rod such that its respective external face is disposed for attachment thereto from said second direction, and further comprising a sixth insert having an external face substantially covered by a first portion of a hook and loop fastener, said sixth insert releasably coupled to said third surface of said curtain rod such that its respective external face is disposed for attachment thereto from said third direction.

16. The assembly of claim 15 wherein:

said first and fourth inserts slidably mount along said first surface of said curtain rod;

said second and fifth inserts slidably mount along said second surface of said curtain rod; and said third and sixth inserts slidably mount along said third surface of said curtain rod.

17. The assembly of claim 7 wherein said first insert is substantially flat.

18. The assembly of claim 1 wherein:

said curtain rod has a generally rectangular cross section and includes first, second, and third channels along said first surface, said second surface, and said third surface, respectively;

wherein said first, second, and third inserts are substantially flat with their external faces substantially covered by said first portion of a hook and loop fastener; and wherein said first insert slidably mates with said first channel, said second insert slidably mates with said second channel; said third insert slidably mates with said third channel.

19. The assembly of claim 18 further comprising:

a first window treatment panel attached to said first insert from a first direction;

a second window treatment panel attached to said second insert from a second direction; and a third window treatment panel attached to said third insert from a third direction.

20. A curtain rod assembly, comprising:

a curtain rod having a longitudinal axis and a generally polygonal cross section generally normal to said longitudinal axis, said curtain rod having at least first, second, and third surfaces disposed substantially parallel to said longitudinal axis and non-coplanar with respect to each other;

first, second, and third inserts each having an external face with a first portion of a hook and loop fastener thereon;

said first insert coupled to said curtain rod such that its respective external face is disposed generally parallel to said first surface of said curtain rod for attachment thereto from a first direction;

said second insert coupled to said curtain rod such that its respective external face is disposed generally parallel to said second surface of said curtain rod for attachment thereto from a second direction; said second direction different from said first direction;

said third insert coupled to said curtain rod such that its respective external face is disposed generally parallel to said third surface of said curtain rod for attachment thereto from a third direction; said third direction different from both said first and second directions;

a first window treatment panel attached to said first insert from a first direction;

a second window treatment panel attached to said second insert from a second direction;

a third window treatment panel attached to said third insert from a third direction; and wherein said first, second, and third window treatment panels are disposed so as to form three overlapping layers for at least a portion thereof.

21. A method of displaying window treatments, comprising:

mounting a curtain rod to a wall, said curtain rod having a longitudinal axis and a generally polygonal cross section generally normal to said longitudinal axis, said curtain rod having at least first, second, and third surfaces disposed substantially parallel to said longitudinal axis and non-coplanar with respect to each other;

movably coupling first, second, and third inserts to said curtain rod, said inserts each having an external face with a first portion of a hook and loop fastener thereon;

attaching a first window treatment panel to said first insert from a first direction;

attaching a second window treatment panel to said second insert from a second direction, said second direction different from said first direction; and attaching a third window treatment panel to said third insert from a third direction, said third direction different from both said first and second directions.

22. The method of claim 21 wherein mounting said curtain rod to a wall comprises attaching at least one mounting bracket to the wall and mating said curtain rod to said mounting bracket so as to support said curtain rod therefrom.

23. The method of claim 21 wherein said mating said curtain rod to said mounting bracket occurs before said attaching said first window treatment panel to said first insert.

24. The method of claim 21 wherein said coupling said first, second, and third inserts to said curtain rod comprises moving said first, second, and third inserts relative to said curtain rod generally parallel to said longitudinal axis prior to said attaching steps.

25. The method of claim 24 wherein moving said first, second, and third inserts relative to said curtain rod comprises sliding said first, second, and third inserts along respective channels on said curtain rod.

26. The method of claim 21 further comprising thereafter removing said first window treatment panel by separating said first window treatment panel from said first insert and thereafter attaching a fourth window treatment panel to said first insert from said first direction.

27. The method of claim 26 further comprising moving said first insert relative to said curtain rod between said removing said first window treatment panel and said attaching said fourth window treatment panel.

28. The method of claim 21 wherein said inserts having lengths substantially less than said curtain rod along said longitudinal axis.

29. The method of claim 28 further comprising:

disposing said first and a fourth insert along said first surface of said curtain rod;

disposing said second and a fifth insert along said second surface of said curtain rod;

disposing said third and a sixth insert along said third surface of said curtain rod;

moving said fourth, fifth, and sixth inserts associated with said curtain rod relative to said curtain rod;

attaching said first window treatment panel to said first and fourth inserts from said first direction;

attaching said second window treatment panel to said second and fifth inserts from said second direction; and attaching said third window treatment panel to said third and sixth inserts from said third direction.

30. A method of displaying window treatments, comprising:

mounting a curtain rod to a wall, said curtain rod having a longitudinal axis and a generally polygonal cross section generally normal to said longitudinal axis, said curtain rod having at least first, second, and third surfaces disposed substantially parallel to said longitudinal axis and non-coplanar with respect to each other;

coupling first, second, and third inserts to said curtain rod, said inserts each having an external face with a first portion of a hook and loop fastener thereon;

attaching a first window treatment panel to said first insert from a first direction;

attaching a second window treatment panel to said second insert from a second direction, said second direction different from said first direction;

attaching a third window treatment panel to said third insert from a third direction, said third direction different from both said first and second directions; and wherein said first, second, and third window treatment panels are disposed so as to form three overlapping layers for at least a portion thereof.

* * * * *